US006017030A

United States Patent [19]

Seidel et al.

[11] Patent Number: 6,017,030

[45] Date of Patent: Jan. 25, 2000

[54] HIGH SPEED FEEDER

[75] Inventors: Randy R. Seidel, Allentown; Neal B. Cohen, Flourtown; Gary Davenport, Sellersville; Roger Honegger, Yardley, all of Pa.

[73] Assignee: Graphic Management Associates, Inc., Bethlehem, Pa.

[21] Appl. No.: 08/955,734

[22] Filed: Oct. 22, 1997

[51] Int. Cl.[7] ..... B65H 3/08; B65H 39/10; B42B 2/00; B65G 42/26

[52] U.S. Cl. ..... 271/101.09; 271/295; 198/418.1; 198/644; 198/779; 270/52.14

[58] Field of Search ..... 271/93, 99, 101 O, 271/100, 106, 109, 119, 272, 273, 295 C, 101, 103, 295; 198/418.1 C, 778, 779 C, 644 C, 380, 418.1, 644, 779; 270/52.16, 52.14 C, 58.21, 52.19, 52.2, 52.14

[56] References Cited

U.S. PATENT DOCUMENTS

| | | | |
|---|---|---|---|
| 503,276 | 6/1893 | Smith | 271/119 |
| 3,599,970 | 8/1971 | Smithe | 270/29 |
| 4,369,962 | 1/1983 | Spiro | 271/11 |
| 4,537,391 | 8/1985 | Watkiss et al. | 271/101 |
| 4,932,645 | 6/1990 | Schorey et al. | 270/56 |
| 4,988,086 | 1/1991 | Schlough | 270/55 |
| 5,213,318 | 5/1993 | Newhall | 270/55 |
| 5,318,287 | 6/1994 | Okayama | 271/10 |

FOREIGN PATENT DOCUMENTS

| | | | |
|---|---|---|---|
| 358069642 | 3/1983 | Japan | 271/119 |
| 404173629 | 6/1992 | Japan | 271/119 |

*Primary Examiner*—William E. Terrell
*Assistant Examiner*—Kenneth Bower
*Attorney, Agent, or Firm*—Jordan B. Bierman; Bierman, Muserlian and Lucas

[57] ABSTRACT

A device for feeding flat, flexible products from the bottom of a stack. The stack is supported by rollers arranged like spokes in a wheel that is continuously rotating. Feeding occurs when a vacuum cup pulls the leading edge of a product between subsequent rollers. A rotary conveyor following feeding employing rollers with irregular surfaces is incorporated to insert the products into a series of pockets passing beneath.

24 Claims, 5 Drawing Sheets

HIGH SPEED FEEDER

The present Invention is directed to a device for individually feeding successive planar, flexible products from a stack thereof. Although the Invention is suitable for any products falling within the foregoing category, it will be described herein with regard to the feeding of newspapers.

BACKGROUND OF THE INVENTION

Because newspapers are so time sensitive, it is necessary to insure that the complete product is assembled rapidly and efficiently. Moreover, since newspapers print a large volume of copies each day, it is important that an absolute minimum number of newspapers are lost or incomplete. When supplements are to be inserted into the outer portion of jacket of a newspaper, this is usually accomplished by providing a plurality of pockets movable in a closed path. A jacket is first introduced into each of the pockets and they are manipulated so as to retain the jackets in an open position. The open jackets within the pockets are then passed beneath feeding stations at which the various additional sections or materials are inserted. Thereafter, the jackets are closed, stacked, and bound together for shipment.

SUMMARY OF THE INVENTION

In order to provide a sufficient number of assembled newspapers within the relatively brief time permitted for doing so, it is necessary that both the jackets and the inserts be fed to the pockets at high speed. Since the various elements making up the newspaper are supplied in stacks, there is a need for a device which will accurately and reliably feed these components to the pockets individually from the bottoms of the respective stacks. The present Invention is intended for this purpose.

In practicing the Invention, there is provided a substantially horizontal support in the form of a hollow circle. Within the circle is a plurality of circumferentially spaced apart tapered rollers which extend from their bases at the perimeter of the circle radially inwardly to their inner ends. The taper is such that, if it were continued, it would come to a point at the center of the circle; however, the rollers are truncated short of that point.

The bases of the rollers are mounted on a rotatable ring which is located adjacent the support. The bases of the tapered rollers are in contact with the stationary support. Thus, when the ring is rotated about its center, the tapered rollers are caused to rotate about their respective axes.

At least one stack of components is placed on the rollers and the ring is caused to rotate. At the same time, a sucker, connected to a source of vacuum, moves up between an upstream roller and a following roller and pulls the leading corner of the paper down below the level of the following roller. As the ring continues to turn, the following roller enters the space between the leading corner (held down by the sucker) and the paper immediately above. Thus, the bottom-most paper is "peeled off" the stack and separated therefrom.

BRIEF DESCRIPTION OF THE DRAWINGS

In the accompanying drawings constituting a part hereof, and in which like reference characters indicate like parts.

FIG. 5 is a schematic overview of the Invention.

DETAILED DESCRIPTION OF THE INVENTION

Figure 1:
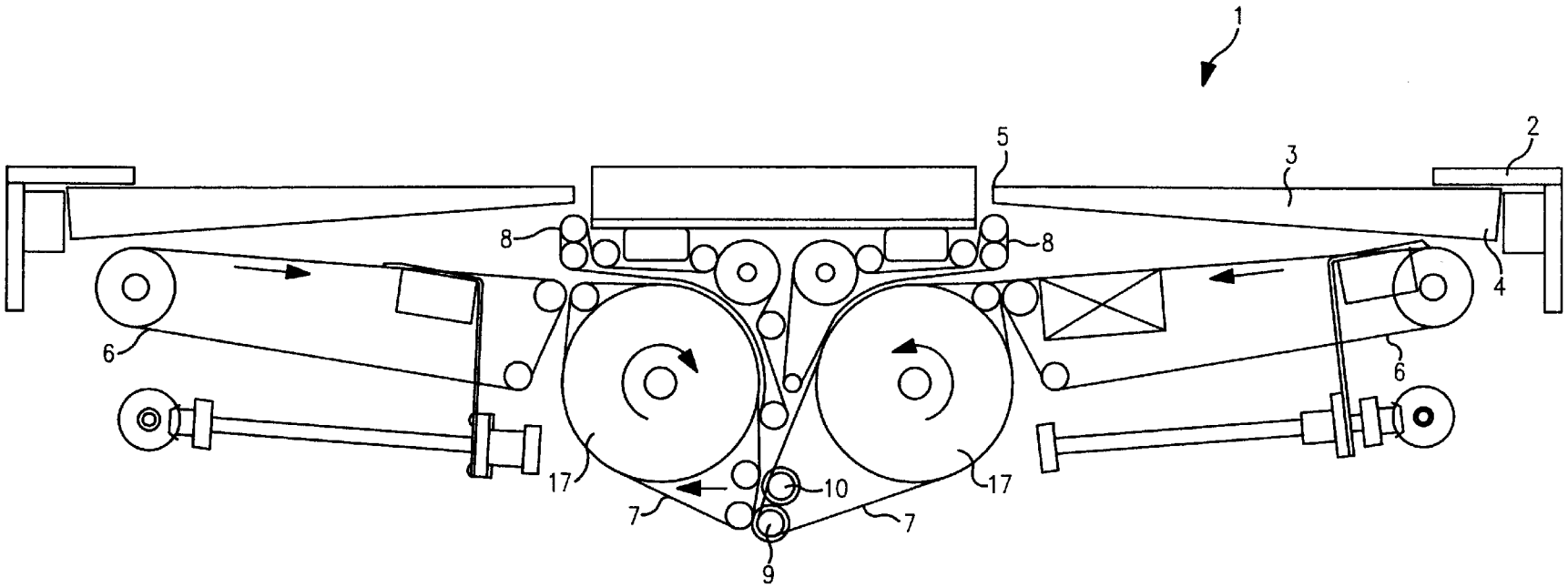
FIG. 1 is a schematic elevation, with some parts omitted for clarity, of the separating device of the present Invention.
Figure 2:
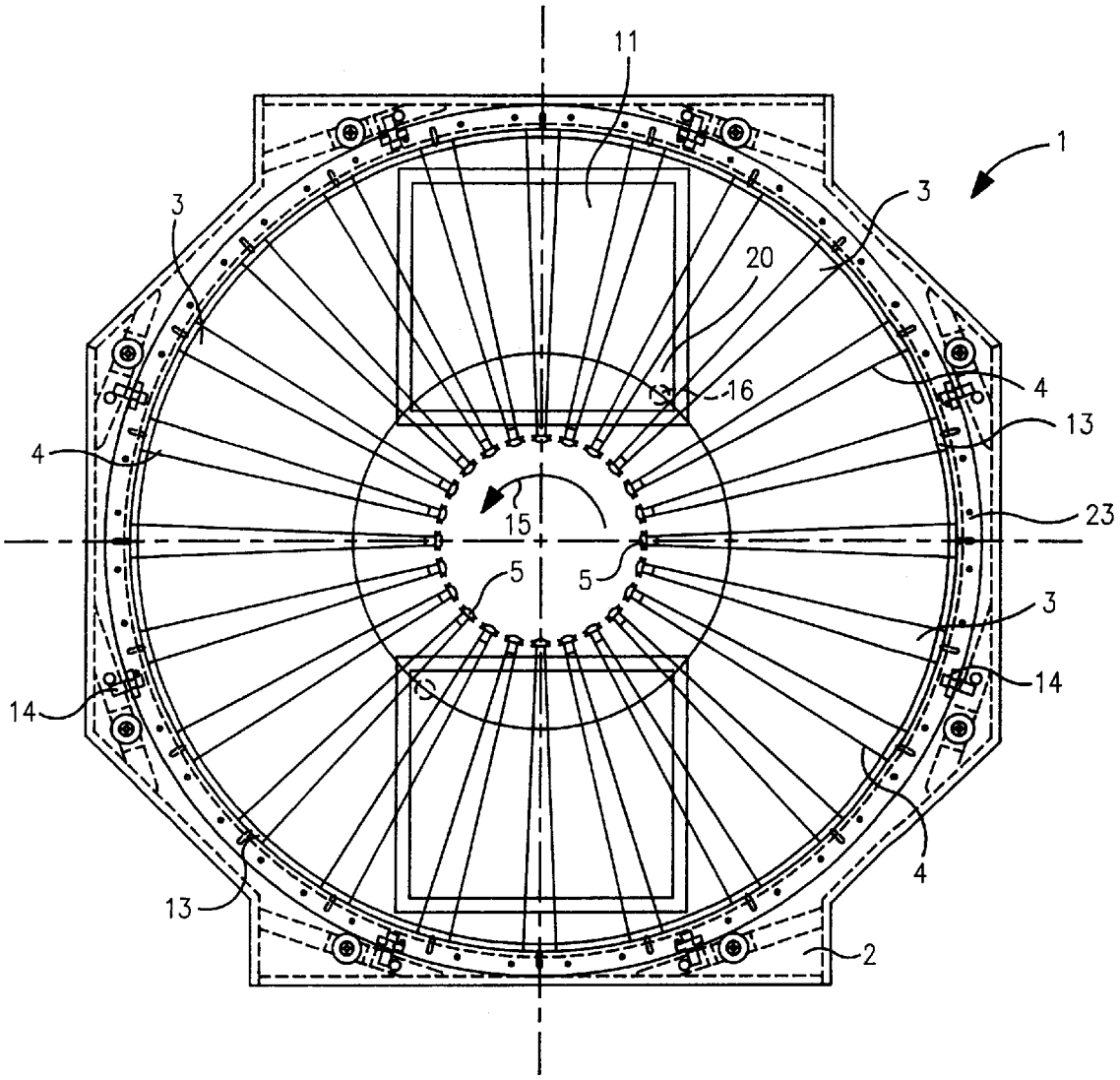
FIG. 2 is a schematic plan view, with parts eliminated for clarity, of the device of the present Invention.

As shown in FIGS. 1 to 5, separating device 1 comprises support 2 carrying tapered rollers 3. Bases 4 of tapered rollers 3 bear against support 2 and inner ends 5 extend radially inward. Sucker 16, connected to a source of vacuum, pulls leading corner 20 below adjacent tapered roller 3.

Figure 4A:
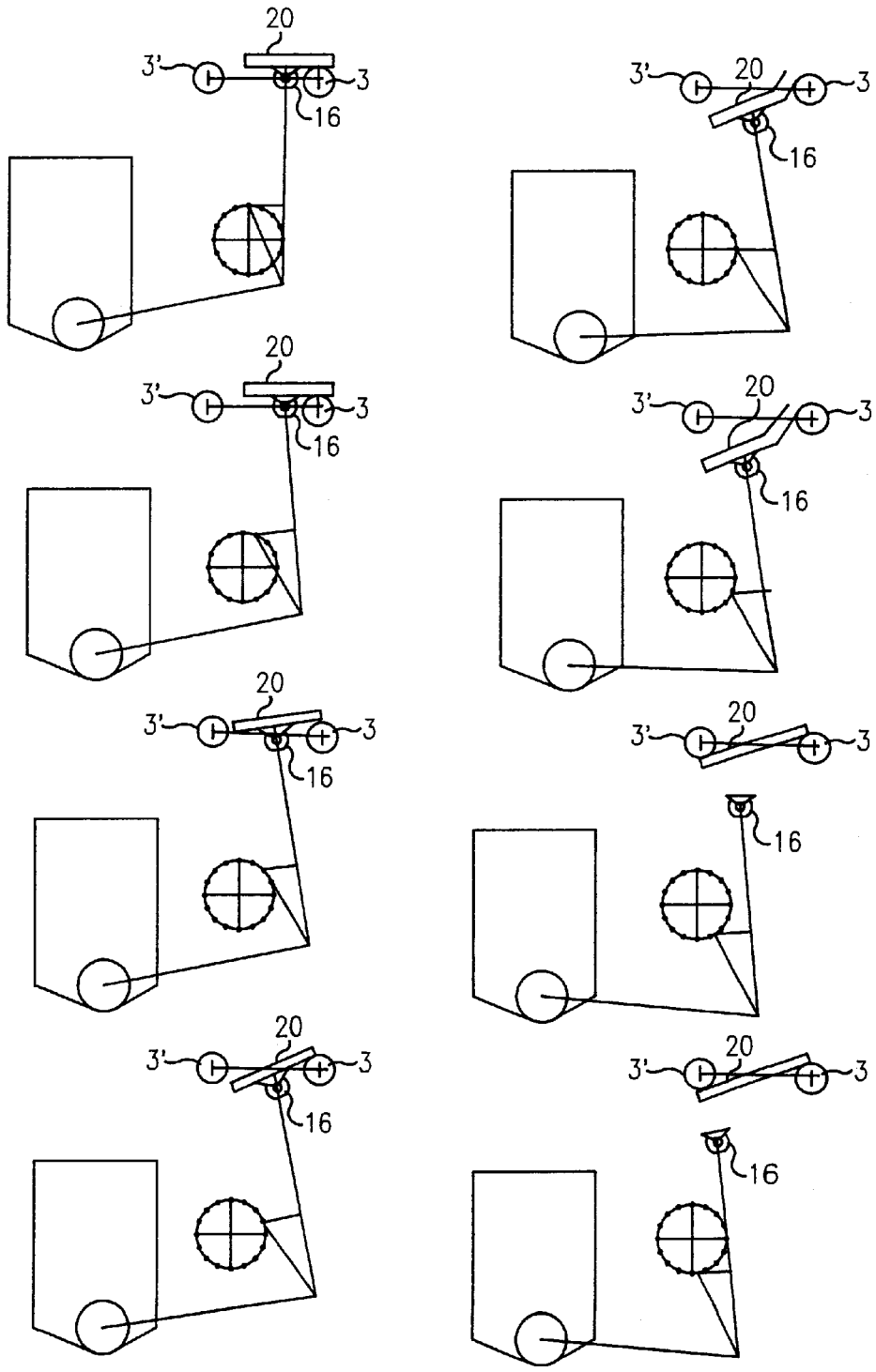
FIGS. 4A and 4B are schematic views showing the action of the sucker.
Figure 4B:
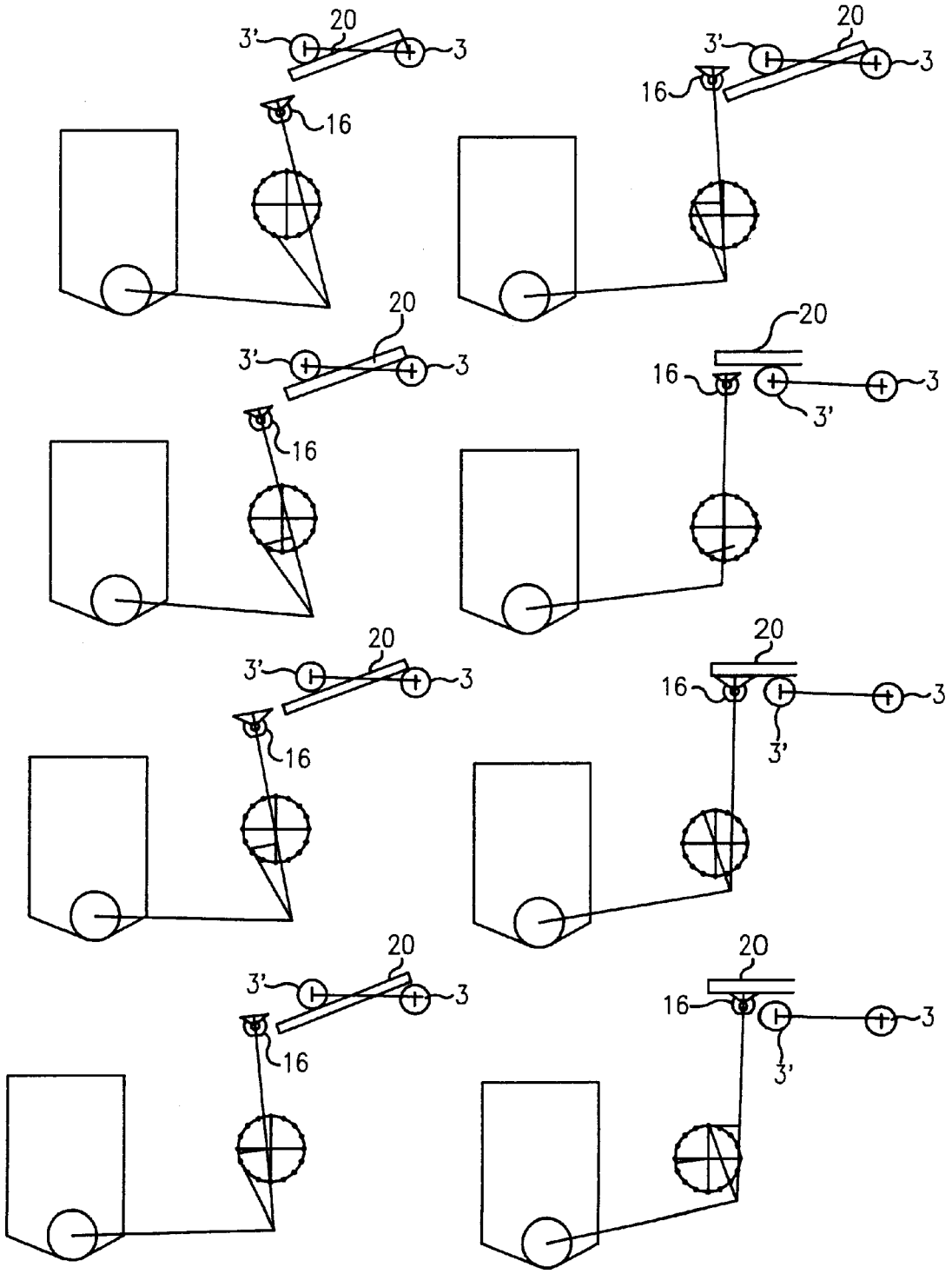

FIGS. 4A and 4B show the complete cycle of sucker 16 with relation to tapered rollers 3 and leading corner 20. The cycle begins at the upper left-hand corner, of FIG. 4A and proceeds down the column on the left, followed by the column immediately to the right, and then analogously to FIG. 4B.

Thus, sucker 16 contacts leading corner 20 between tapered rollers 3 and 3'. As vacuum is applied to sucker 16 and it is moved downward, it carries leading corner 20 with it until it is below the level of tapered roller 3'. As tapered roller 3' moves to the right, it rolls on top of leading edge 20 and sucker 16 is released. The cycle continues as roller 3' moves further to the right and sucker 16 moves below roller 3' and then, as shown in the right-hand column of FIG. 4, moves up again behind roller 3' to contact the next paper at its leading corner 20.

As can more readily be seen in FIG. 1, the paper, after separation by rollers 3, falls by gravity onto feed belt 6. It is carried to, and gripped between, discharge belt 7 and guide belt 8. Since belts 7 and 8, as well as discharge roller 17, are moving faster than feed belt 6, the speed of the paper is increased. It moves around discharge roller 17 between upstream rollers 10 and downstream rollers 9 to be ejected into moving pockets (not shown) passing underneath.

Figure 3:
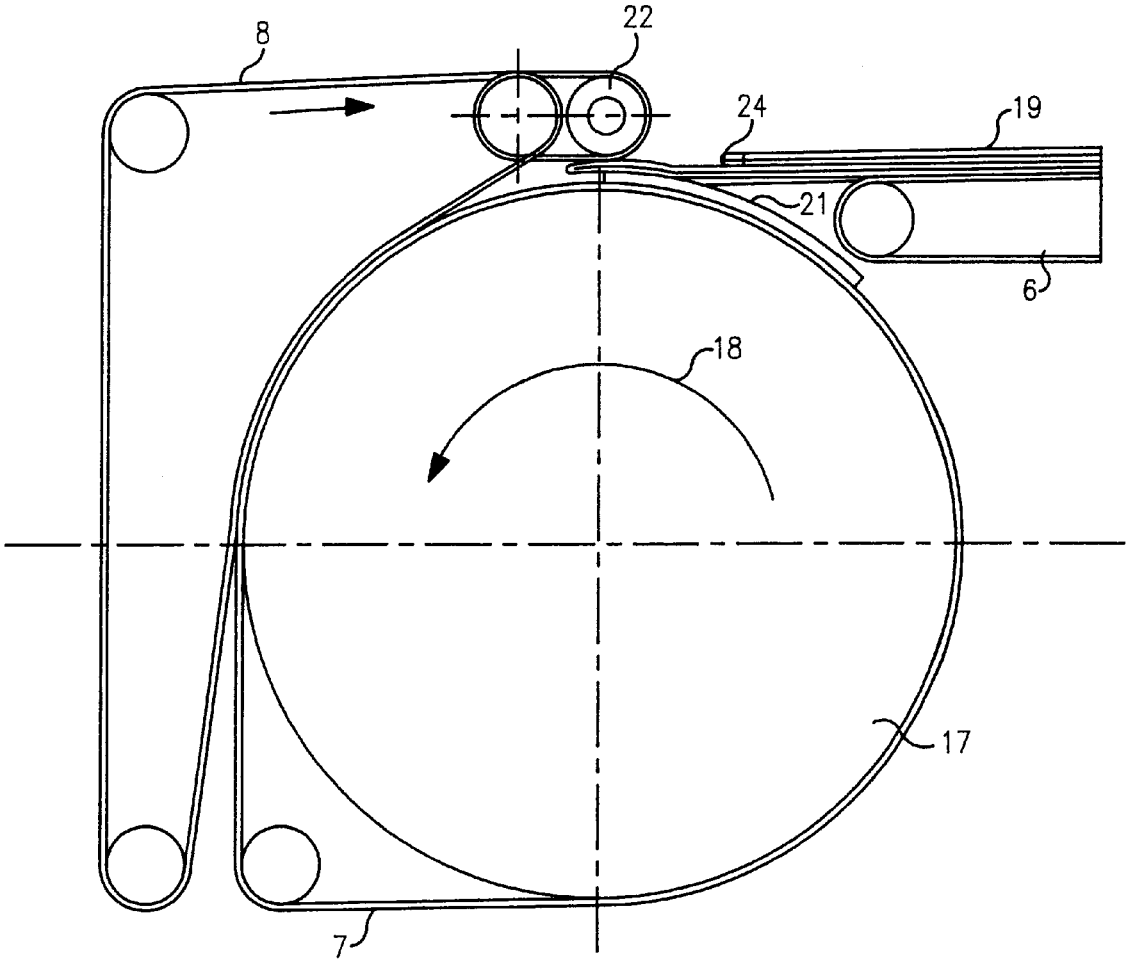
FIG. 3 is an enlarged schematic view of one of the discharge rollers showing the paper being gripped for acceleration and discharge.

A modified form of the device is shown in FIG. 3. Newspapers 19 are delivered by feed belt 6 to nip roller 22. As discharge roller 17 turns in the direction of arrow 18, bump 21 contacts paper 19 just behind leading edge 24. Thus, paper 19 is securely gripped between bump 21 and nip roller 22. Since paper 19 is accelerated at this point, bump 21 provides added insurance against slippage.

Although certain specific embodiments of the present Invention have been expressly described, it is, nonetheless, to be broadly construed and not to be limited except by the character of the claims appended hereto.

What we claim is:

1. A device for separation of individual planar, flexible products from a first stack thereof comprising:

a substantially horizontal, hollow circular support having a center and a perimeter, a plurality of rollers spaced apart around said perimeter, each of said rollers having a surface, said rollers tapering radially inwardly from their bases at said perimeter to their inner ends, said support being rotatable about said center in a rotation direction, each of said products being substantially rectangular and having a first portion and a second portion, said first portion located in said rotation direction relative to said second portion, a vacuum sucker connected to a vacuum source which contacts said second portion when said second portion projects between a first roller and an adjacent second roller, said vacuum sucker pulling said second portion beneath said second roller, whereby, as said rollers are driven in said rotation direction, said second portion of said product is drawn beneath said second roller.

2. The device of claim 1 wherein each of said rollers is tapered at an angle such that an extension of said surface would come to a point at said center.

3. The device of claim 1 wherein said rollers are axially shorter than radii of said hollow circle, whereby said inner ends form an inner circle concentric with said hollow circle.

4. The device of claim 1 wherein there is a second stack on some of said rollers located diametrically opposite said first stack.

5. The device of claim 1 wherein said upstream portion is a corner of said product.

6. The device of claim 1 wherein there is a plurality of stacks of said products, said stacks being spaced apart circumferentially on said tapered rollers.

7. The device of claim 1 comprising a discharge roller, a nip roller adjacent said discharge roller and separated therefrom by a gap, at least one bump on an outer surface of said discharge roller and extending only part way around a circumference of said discharge roller, said bump being located so as to nip each of said products in said gap.

8. The device of claim 7 wherein there are at least two said bumps spaced apart circumferentially around said surface.

9. The device of claim 7 wherein each of said products has a leading edge, said bump contacting each of said products a given distance upstream of said leading edge.

10. The device of claim 7 wherein said given distance is about 1 inch.

11. The device of claim 1 wherein said rollers have axes and rotate around said axes.

12. The device of claim 11 wherein said rollers are provided with frictional surfaces at or adjacent said bases to cause rotation around said axes.

13. The device of claim 12 comprising a stationary friction element at said perimeter and contacting said frictional surfaces, whereby relative rotation between said perimeter and said bases causes said rotation around said axes.

14. The device of claim 11 wherein said rollers are provided with gears at or adjacent said bases to cause rotation around said axes.

15. The device of claim 14 comprising a stationary ring gear at said perimeter engaging said gears at or adjacent said bases, whereby relative rotation between said perimeter and said bases causes said rotation around said axes.

16. The device of claim 14 wherein said rollers are provided with gears at said inner ends.

17. The device of claim 1 wherein there is an inner ring at or adjacent said inner circle, said inner ring having a plurality of circumferentially spaced apart holes, one of said inner ends in each of said holes.

18. The device of claim 17 wherein a first reduced friction bearing is mounted in each of said holes, said inner end being within said first friction bearing.

19. The device of claim 17 wherein said products are folded and have folded edges, said corner is at one end of one of said folded edges.

20. The device of claim 19 wherein said edges are glued.

21. The device of claim 17 wherein a first reduced friction bearing is on each of said inner ends within each of said holes.

22. The device of claim 21 wherein said first bearing is a ball bearing.

23. The device of claim 17 wherein said inner ring is supported by a platform.

24. The device of claim 21 wherein there is a second reduced friction bearing between said platform and said inner ring.

* * * * *